US007694669B2

(12) United States Patent
Campo

(10) Patent No.: US 7,694,669 B2
(45) Date of Patent: Apr. 13, 2010

(54) PAINTBALL LOADER FEED MECHANISM

(75) Inventor: John E. Campo, Medord, NJ (US)

(73) Assignee: Kee Action Sports I, LLC, Sewell, NJ (US)

( * ) Notice: Subject to any disclaimer, the term of this patent is extended or adjusted under 35 U.S.C. 154(b) by 807 days.

(21) Appl. No.: 11/297,770

(22) Filed: Dec. 8, 2005

(65) Prior Publication Data

US 2006/0196489 A1 Sep. 7, 2006

Related U.S. Application Data

(60) Provisional application No. 60/634,132, filed on Dec. 8, 2004.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | | |
|---|---|---|---|---|
| 1,403,689 | A | 1/1922 | Hyndman | |
| 1,403,719 | A | 1/1922 | Szepe | |
| 1,404,689 | A | 1/1922 | Fairweather | |
| 1,743,576 | A | 1/1930 | Bigham | |
| 1,867,513 | A | 7/1932 | Johannes | |
| 1,954,093 | A | 4/1934 | Nelson | |
| 2,307,015 | A | 1/1943 | Boynton | |
| 2,357,951 | A | 9/1944 | Hale | |
| 2,398,263 | A | 4/1946 | Trimbach | |
| 2,639,904 | A | 5/1953 | McMaster | |
| 2,641,412 | A | 6/1953 | Byberg | |
| 3,248,008 | A | 4/1966 | Meierjohan | |
| 3,384,354 | A | 5/1968 | Albrecht et al. | |
| 3,467,073 | A | 9/1969 | Rhodes | |
| 3,610,223 | A | 10/1971 | Green | |
| 3,695,246 | A | 10/1972 | Filippi et al. | |
| 3,788,298 | A | 1/1974 | Hale | |
| 3,789,891 | A | 2/1974 | Bosch | |
| 3,844,267 | A | 10/1974 | Mohr | |
| 3,855,988 | A | 12/1974 | Sweeton | |
| 3,867,921 | A | 2/1975 | Politzer | |
| 4,027,646 | A | 6/1977 | Sweeton | |
| 4,185,824 | A | 1/1980 | Natwick | |
| 4,207,857 | A | 6/1980 | Balka, Jr. | |
| 4,332,097 | A | 6/1982 | Taylor, Jr. | |
| 4,646,709 | A | 3/1987 | Kholin | |
| 4,759,435 | A * | 7/1988 | Cedrone | 198/459.8 |
| 4,819,609 | A | 4/1989 | Tippmann | |
| 4,850,330 | A | 7/1989 | Nagayoshi | |

(Continued)

FOREIGN PATENT DOCUMENTS

| | | |
|---|---|---|
| DE | 876370 | 5/1953 |

(Continued)

*Primary Examiner*—John Ricci
(74) *Attorney, Agent, or Firm*—Volpe and Koenig, P.C.

(57) ABSTRACT

An improved paintball feed mechanism for a paintball loader is disclosed, including a drive shaft and a motor for actuating the drive shaft. At least on rigid projection is provided connected to the drive shaft by an elastic member. The elastic member is formed so that it will bend when the rigid projection encounters a jammed or stationary paintball in the paintball loader, thus preventing paintball breakage.

7 Claims, 15 Drawing Sheets

U.S. PATENT DOCUMENTS

| | | | |
|---|---|---|---|
| 4,896,646 | A | 1/1990 | Kahelin et al. |
| 4,926,742 | A | 5/1990 | Ma et al. |
| 4,930,400 | A | 6/1990 | Brandl et al. |
| 4,936,282 | A | 6/1990 | Dobbins et al. |
| 4,951,548 | A | 8/1990 | Wixon et al. |
| 4,951,644 | A | 8/1990 | Bon |
| 4,965,951 | A | 10/1990 | Miller et al. |
| 4,986,251 | A | 1/1991 | Lilley |
| 4,993,400 | A | 2/1991 | Fitzwater |
| 5,063,905 | A | 11/1991 | Farrell |
| 5,097,816 | A | 3/1992 | Miller |
| 5,097,985 | A | 3/1992 | Jones |
| 5,166,457 | A | 11/1992 | Lorenzetti |
| 5,282,454 | A | 2/1994 | Bell et al. |
| 5,335,579 | A | 8/1994 | David |
| 5,353,712 | A | 10/1994 | Olson |
| 5,361,746 | A | 11/1994 | Szente |
| 5,383,442 | A | 1/1995 | Tippmann |
| 5,456,153 | A | 10/1995 | Bentley et al. |
| 5,490,493 | A | 2/1996 | Salansky |
| 5,497,758 | A | 3/1996 | Dobbins et al. |
| 5,505,188 | A | 4/1996 | Williams |
| 5,511,333 | A | 4/1996 | Farrell |
| 5,520,171 | A | 5/1996 | David |
| 5,542,570 | A | 8/1996 | Nottingham et al. |
| 5,561,258 | A | 10/1996 | Bentley et al. |
| 5,600,083 | A | 2/1997 | Bentley et al. |
| 5,722,383 | A | 3/1998 | Tippmann |
| 5,727,538 | A | 3/1998 | Ellis |
| 5,736,720 | A | 4/1998 | Bell et al. |
| 5,749,797 | A | 5/1998 | Sunseri et al. |
| 5,771,875 | A | 6/1998 | Sullivan |
| 5,784,985 | A | 7/1998 | Lodico et al. |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,839,422 | A | 11/1998 | Ferris |
| 5,881,962 | A | 3/1999 | Schmidt et al. |
| 5,887,578 | A | 3/1999 | Backeris et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,109,252 | A | 8/2000 | Stevens |
| 6,206,562 | B1 | 3/2001 | Eyraud et al. |
| 6,213,110 | B1 | 4/2001 | Christopher et al. |
| 6,220,237 | B1 | 4/2001 | Johnson et al. |
| 6,305,367 | B1 | 10/2001 | Kotsiopoulos |
| 6,327,953 | B1 | 12/2001 | Andresen |
| 6,347,621 | B1 | 2/2002 | Guthrie |
| 6,374,819 | B1 | 4/2002 | Ming-Hsien |
| 6,408,836 | B1 | 6/2002 | Ming-Hsien |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,425,781 | B1 | 7/2002 | Bernstein et al. |
| 6,460,530 | B1 | 10/2002 | Backeris et al. |
| 6,467,473 | B1 | 10/2002 | Kostiopoulos |
| 6,468,879 | B1 | 10/2002 | Lamure et al. |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 6,526,955 | B1 | 3/2003 | Juan |
| 6,588,412 | B2 | 7/2003 | Ferrara et al. |
| 6,591,824 | B2 | 7/2003 | Hatcher |
| 6,609,511 | B2 | 8/2003 | Kotsiopoulos |
| 6,615,814 | B1 | 9/2003 | Rice et al. |
| 6,644,293 | B2 | 11/2003 | Jong |
| 6,684,873 | B1 | 2/2004 | Anderson |
| 6,701,907 | B2 | 3/2004 | Christopher et al. |
| 6,708,685 | B2 | 3/2004 | Masse |
| 6,725,852 | B1 | 4/2004 | Yokota |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho |
| 6,752,137 | B2 | 6/2004 | Brunette |
| 6,792,933 | B2 | 9/2004 | Christopher et al. |
| 6,802,306 | B1 | 10/2004 | Rice |
| 6,860,258 | B2 | 3/2005 | Farrell |
| 6,889,680 | B2 | 5/2005 | Christopher et al. |
| 6,915,792 | B1 | 7/2005 | Sheng |
| 6,978,776 | B2 | 12/2005 | Hamilton |
| 6,981,493 | B1 | 1/2006 | Poteracku |
| 7,017,569 | B2 | 3/2006 | Jong |
| 7,021,302 | B2 | 4/2006 | Neumaster |
| 7,077,118 | B2 | 7/2006 | Lewis |
| D535,339 | S | 1/2007 | Broersma |
| 7,159,585 | B2 | 1/2007 | Quinn et al. |
| D544,047 | S | 6/2007 | Bell et al. |
| 7,234,456 | B2 | 6/2007 | Andresen |
| 7,270,121 | B2 | 9/2007 | Lubben |
| 7,343,909 | B2 | 3/2008 | Christopher et al. |
| D567,302 | S | 4/2008 | Choi |
| D567,303 | S | 4/2008 | Neumaster |
| 2002/0059927 | A1 | 5/2002 | Woods |
| 2003/0079731 | A1 | 5/2003 | Dobbins |
| 2004/0112356 | A1 | 6/2004 | Hatcher |
| 2004/0211402 | A1 | 10/2004 | Christopher et al. |
| 2004/0245276 | A1 | 12/2004 | Hashimoto et al. |
| 2005/0121015 | A1 | 6/2005 | Postorivo, Jr. |
| 2005/0188974 | A1 | 9/2005 | Pedicini et al. |
| 2005/0241628 | A1 | 11/2005 | Hatcher |
| 2005/0274370 | A1 | 12/2005 | Lubben |
| 2005/0284456 | A1 | 12/2005 | Chipley |
| 2005/0284457 | A1 | 12/2005 | Hatcher |
| 2006/0005823 | A1 | 1/2006 | Quinn |
| 2006/0032488 | A1 | 2/2006 | Telford |
| 2006/0037597 | A1 | 2/2006 | Wood |
| 2006/0054151 | A1 | 3/2006 | Christopher et al. |
| 2006/0086347 | A1 | 4/2006 | Hedberg |
| 2006/0124118 | A1 | 6/2006 | Dobbins |
| 2006/0249131 | A1 | 11/2006 | Broersma |
| 2006/0254572 | A1 | 11/2006 | Hall |
| 2007/0017495 | A1 | 1/2007 | Andresen |
| 2007/0056573 | A1 | 3/2007 | Campo |
| 2007/0062506 | A1 | 3/2007 | Bell |
| 2007/0083420 | A1 | 4/2007 | Andresen |
| 2007/0101981 | A1 | 5/2007 | Chen |
| 2007/0113834 | A1 | 5/2007 | Spicer |
| 2007/0137631 | A1 | 6/2007 | Christopher |

FOREIGN PATENT DOCUMENTS

| | | |
|---|---|---|
| DE | 3721527 | 1/1989 |
| DE | 4343870 | 6/1994 |
| DE | 19922589 | 12/2000 |
| EP | 01054228 | 11/2000 |
| EP | 01653189 | 5/2006 |
| FR | 921527 | 5/1947 |
| GB | 2322438 | 8/1998 |
| JP | 1179898 | 7/1989 |
| WO | 98/13660 | 4/1998 |
| WO | 01/44745 | 6/2001 |
| WO | 0242708 | 5/2002 |
| WO | 2007035601 | 3/2007 |

* cited by examiner

PAINTBALL LOADER FEED MECHANISM

This application claims the benefit of U.S. Provisional Patent Appln. No. 60/634,132, filed Dec. 8, 2004, the entire contents of which are incorporated fully by reference herein.

FIELD OF THE INVENTION

The present invention is directed to the field of feed mechanisms for loaders, hoppers or magazine, in the sport of paintball.

BACKGROUND

A popular game has developed over the years uses compressed gas guns known as paintball markers. Players use the paintball markers to shoot paintballs. These paintballs are generally spherical capsules formed from gelatin and filled with paint (food coloring, dye, etc.). During play of the game, the players on each team advance towards each other. A player is eliminated from the game when the player is hit by a paintball fired from an opposing player's marker. When the paintball hits a player, a "splat" of paint is left on the player.

Typically, an existing paintball loader or hopper (referred to herein as "loader") includes a housing which is placed on a paintball gun. The loader is shaped to hold a large quantity of paintballs. The loader has an outlet or outfeed tube through which the paintballs are fed to be fired by the paintball marker. The outlet tube leads to an inlet tube located on the upper portion of the gun. Several paintball loaders are described in U.S. Pat. Nos. 6,213,110, 6,502,567, and 6,792,933, the entire contents of which are incorporated by reference herein.

There are two main classes of paintball loaders, each having feed mechanisms for mixing or moving paintballs. The first class includes "gravity feed" or "agitating" loaders, such as shown in U.S. Pat. No. 5,947,100, the entire contents of which is incorporated by reference. Such loaders generally include a housing that holds a plurality of paintballs. An agitator, for mixing, stirring, or otherwise moving the paintballs is positioned within the housing to increase feed rates and prevent paintball jams, i.e., where paintballs become stuck exiting through the loader outfeed tube. The agitators can take various forms, including paddle wheels, shaped members, arms, paddles, wires, fins, and vibrating members. Generally, the agitators are connected to a drive shaft and rotated or otherwise actuated by a motor. The agitators are normally formed from hard plastic or metal. Some known gravity feed loaders are sold under the brand names EMPIRE RELOAD HOPPER II, and HALO TSA.

The second main class of paintball loader includes "active feed" or "force feed" paintball loaders. These loaders force paintballs out of the outfeed tube, allowing for increased feeding rates. In an active feed paintball loader, the force feed mechanisms can take the form of drive cones, fins, paddles, arms, conveyors, carriers, or any other arrangements whereby paintball can be forced into or through the outfeed tube of the loader. Active feed paintball loaders generally use sensors to monitor a stack of paintballs ("paintball stack") as the paintballs are forced from the outfeed tube. In some active feed loaders, the sensors are adapted to send signals to a motor for rotating the force feed mechanism. Advanced active feed loaders, such as disclosed in U.S. Pat. No. 6,213,110, include electronic circuitry and microprocessors to control and/or monitor the operation of the loaders. Some known force feed paintball loaders are sold under the brand names HALO B, and EMPIRE RELOADER B.

A significant problem with paintball loaders is the tendency to develop paintball jams, which result in "ball chop" or breakages. Because active paintball loaders force paintballs from the loader into a paintball marker, if a paintball become jammed, the forces on the paintballs may be enough to rupture the jammed or immobile paintball. Several solutions have been attempted to curb breakages. For example, U.S. Pat. Nos. 6,701,907 and 5,954,042, the entire contents of which are incorporated herein by reference, utilize spring-loaded feeders (a drive cone and a paddle wheel respectively). In those arrangements, if a paintball jam occurs, the agitators will not rupture the jammed paintball as the spring is wound. The entire agitators are spring-loaded, while the individual fins of the disclosed drive cone, and the paddle arms, are rigid.

Other solutions include the use a flexible impeller having a hub and arms completely formed from a flexible materials, such as shown in U.S. Published patent application Ser. No. 10/650,075. In that arrangement, the arms continually flex against the paintballs in the loader. Because the entire length of the arms is completely flexible, all of the energy from the motor is not transferred to the paintballs. The flexible impellers constantly bend as they encounter paintballs, which can potentially result in misfeeds or gaps in a paintball stack as the flexible impellers pass by paintballs. In addition, as the feed rates of high end paintball loaders and paintball markers increases, the flexible impellers may flex around and pass paintballs in a paintball stack that are not jammed. In practice, the flexible impellers may lose their flexibility and fail to keep any tension on the paintballs. They flexible impellers may also lose their shape, so that instead of pushing paintballs toward the outfeed tube, the flexible impellers push them into the sidewalls of the loader. When they flexible impellers flex downward and upward, they may end up pushing paintballs up into the air and "popcorning" them out of the drive system. With flexible impellers, an action that is constantly pushing the paintballs at the right point and in the direction required for proper feeding.

Accordingly, there is a need for an improved paintball fee mechansim that will not break paintballs, having projections that include a rigid portion and an elastic portion.

SUMMARY OF THE INVENTION

An improved paintball feed mechanism for a paintball loader is disclosed, including a drive shaft and a motor for actuating the drive shaft. At least on rigid projection is provided connected to the drive shaft by an elastic member. The elastic member is formed so that it will bend when the rigid projection encounters a jammed or stationary paintball in the paintball loader, thus preventing paintball breakage.

An improved paintball loader is also disclosed, including a housing for holding a plurality of paintballs. The housing having an exit opening leading to an outfeed tube. A feed mechanism is provided in the housing, the feed mechanism including a drive shaft, at least one rigid projection, and an elastic member provided between the drive shaft and the rigid projection. The elastic member is adapted to bend when the projection meets a stationary or jammed paintball. A motor for actuating the drive shaft may also be provided.

DETAILED DESCRIPTION OF THE PREFERRED EMBODIMENT(S)

Figure 1:
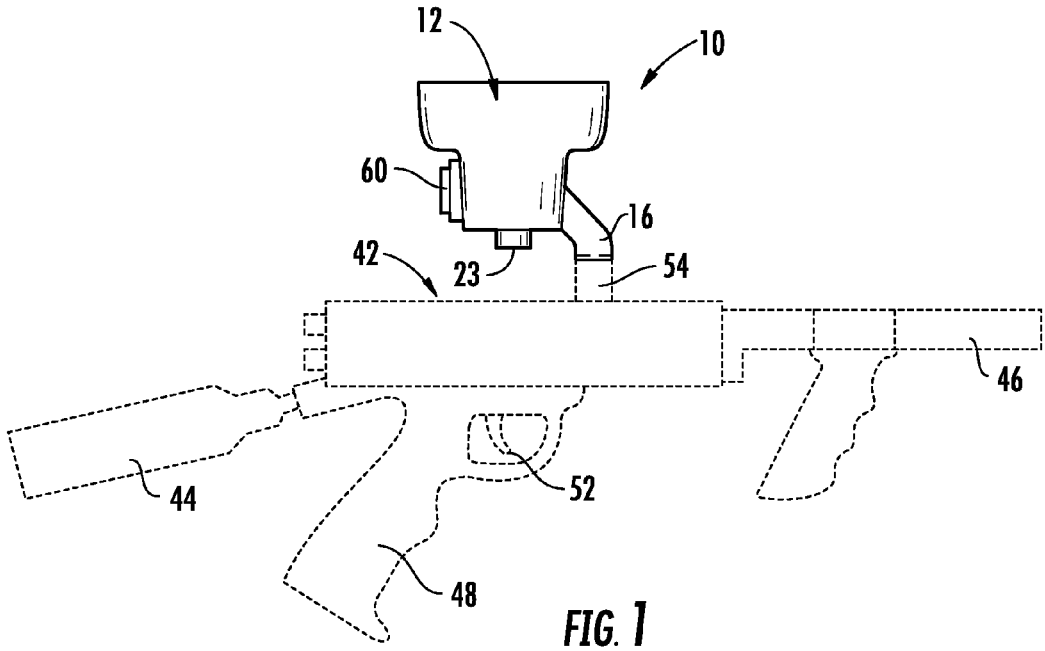
FIG. 1 illustrates a side elevational view of a feed paintball loader as it may be operatively attached to a representative paintball gun illustrated in phantom.

FIG. 1 shows a side elevational view of a paintball loader 10 operatively attached to a representative paintball marker 41 illustrated in phantom. The paintball marker 41 includes a main body 42, a barrel 46, a grip 48, and a trigger 52. An infeed tube 54 is provided for connection to the outfeed tube 16 of the paintball loader 10. A compressed gas cylinder 44 is attached to the marker 41. The paintball marker 41 also includes an inlet tube 40 leading to a firing chamber (not shown) in the interior of the main body 42. The compressed gas cylinder 44 normally contains CO2, or nitrous, although any compressible gas may be used.

Figure 2:
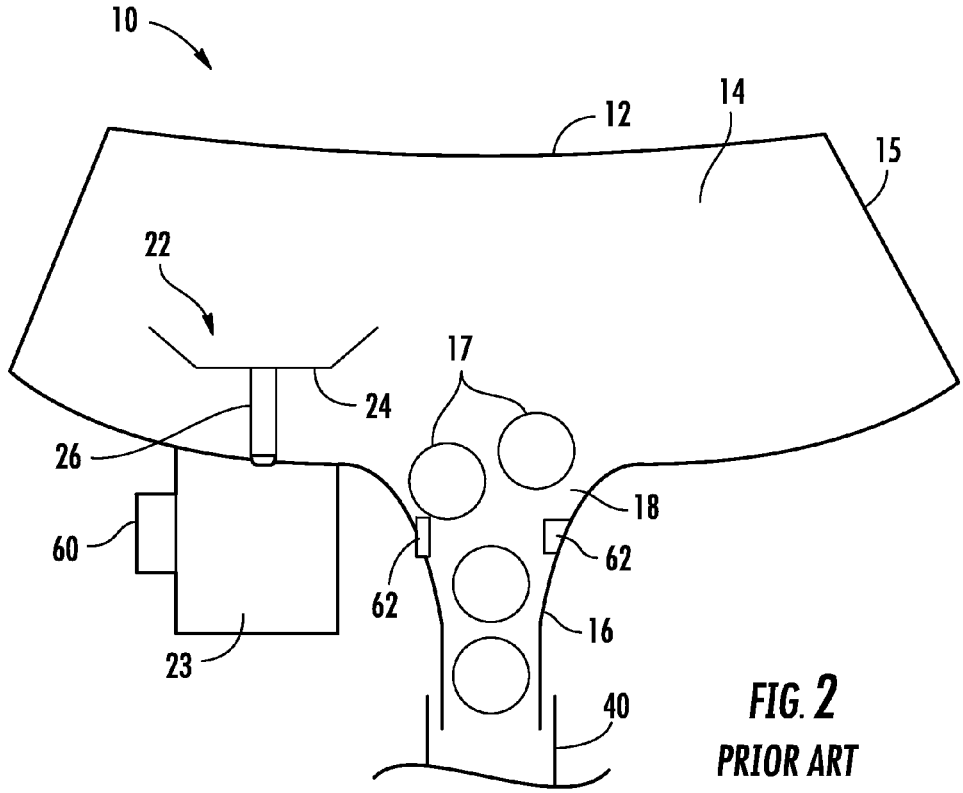
FIG. 2 PRIOR ART
FIG. 2 illustrates a cross sectional side view of a prior art gravity feed paintball loader.
Figure 9:
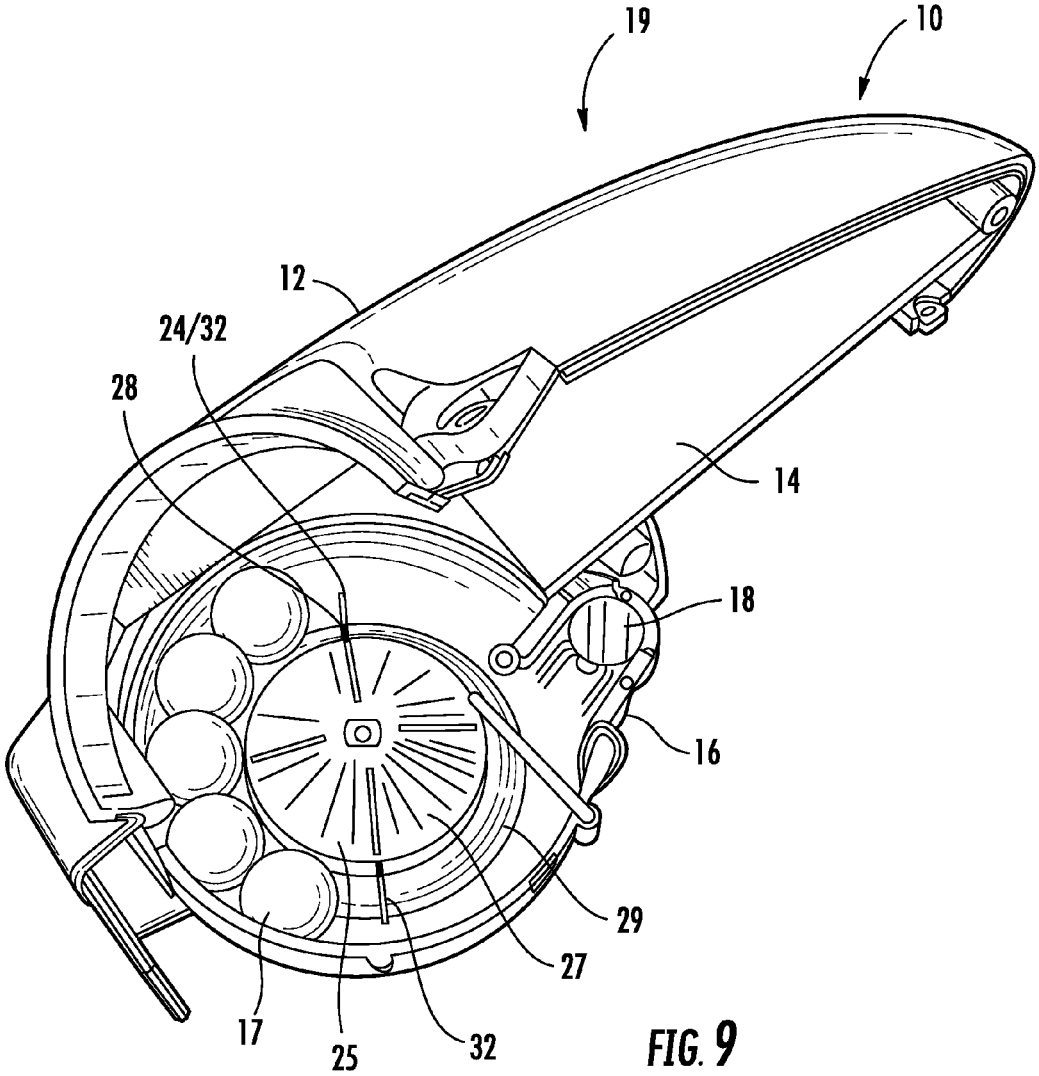
FIG. 9 illustrates an active feed paintball loader such as illustrated in FIG. 2A, incorporating the improved feed mechanism of the present invention.
Figure 10:
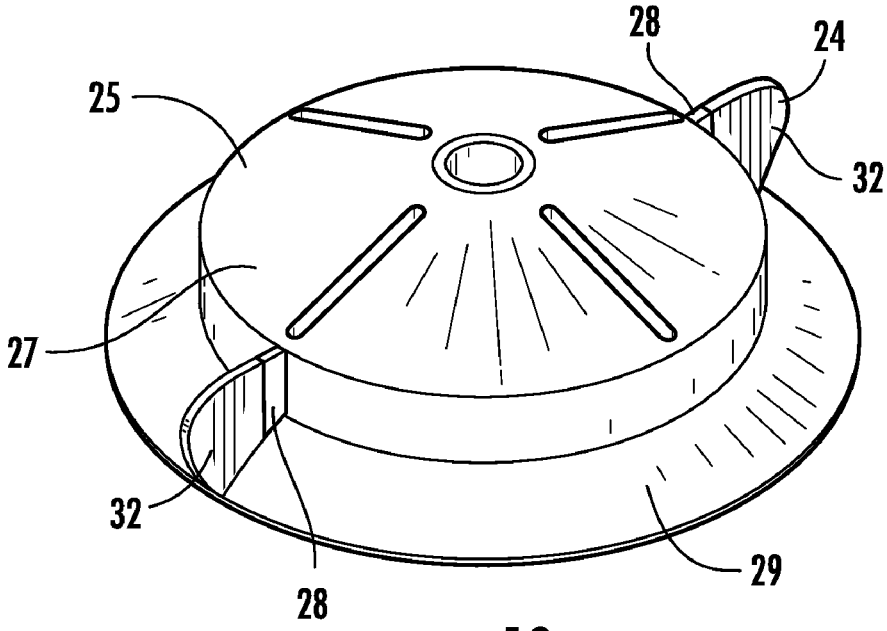
FIG. 10 illustrates a feed mechanism of the present invention formed as a drive cone for an active feed paintball loader.
Figure 11:
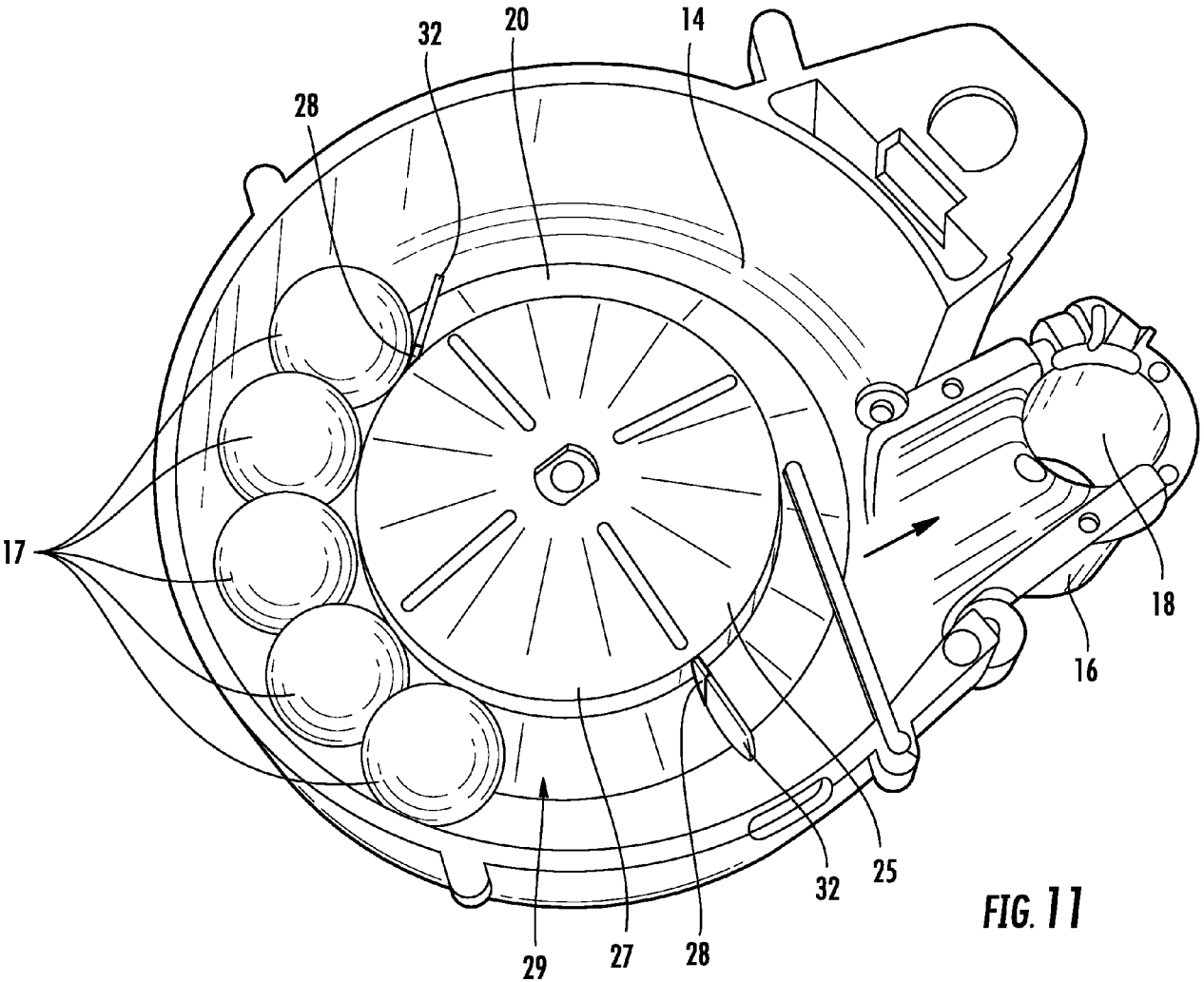
FIG. 11 illustrates a top interior cutaway view of the paintball loader of FIG. 9 illustrating the feed mechanism of the present invention, the exit opening, and a plurality of paintballs, with the elastic member of the agitator flexing upon encountering a stationary or jammed paintball.
Figure 12:
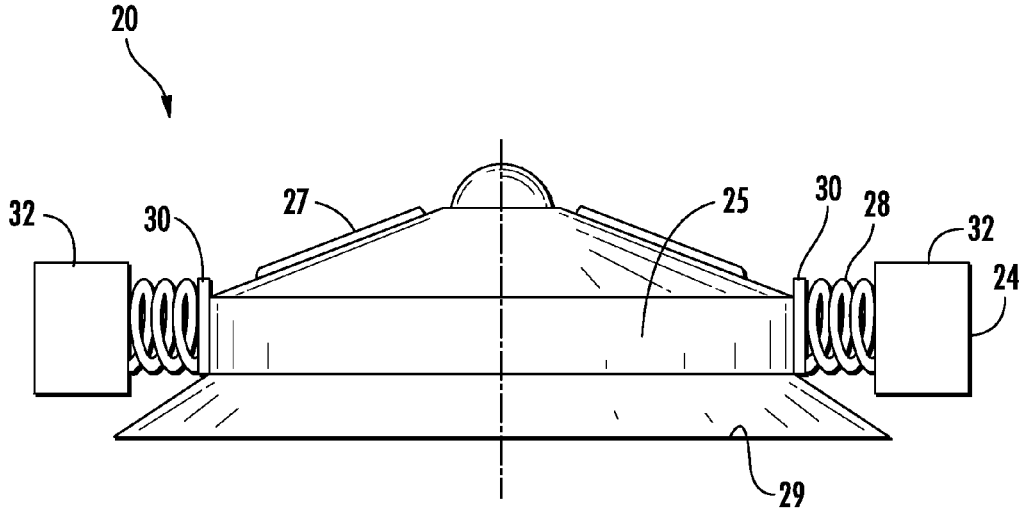
FIG. 12 illustrates a side elevational view of an embodiment of a feed mechanism of the present invention as a drive cone for an active feed paintball loader.
Figure 12A:
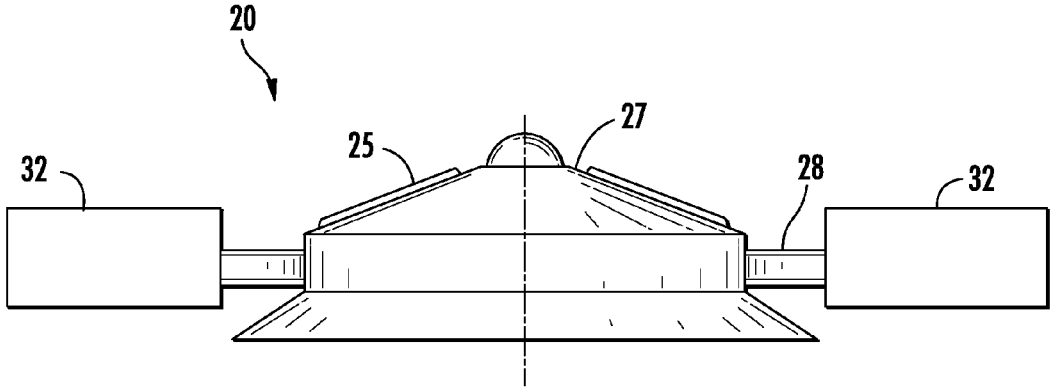
FIG. 12A illustrates a side elevational view of an embodiment of a feed mechanism of the present invention as a drive cone for an active feed paintball loader.

As shown in FIGS. 1 and 2, a typical prior art paintball loader 10 generally includes a housing 12 forming an interior chamber 14 for receiving paintballs 17. In either a gravity feed loader 15 or an active feed loader 19 (such as shown in FIG. 9), an exit opening 18 leads to an outfeed tube 16. The outfeed tube 16 is positioned to feed paintballs 17 to the inlet tube 40 or breech 42 associated with the main body 42 of a paintball marker 41. A feed mechanism is provided as an agitator 22 is positioned at a location in the housing 12, usually adjacent the bottom portion.

As shown in FIG. 2, the feed mechanism may be an agitator 22 of any kind, a paddle turning on a shaft, a paddle wheel, curved arms, or any other arrangement, projection 24 or extension that can agitate, stir, mix, or otherwise move paintballs 17 to prevent a jam or breakage after a jam. The feed mechanism 20 includes a drive shaft 26 that is coupled to a motor 23. Activation of the motor 23 rotates or otherwise moves the drive shaft 26, and thus moves the agitator 22. In a gravity-feed loader 15, this will stir paintballs 17, to prevent jams at the exit opening 18 for proper feeding.

Figure 2A:
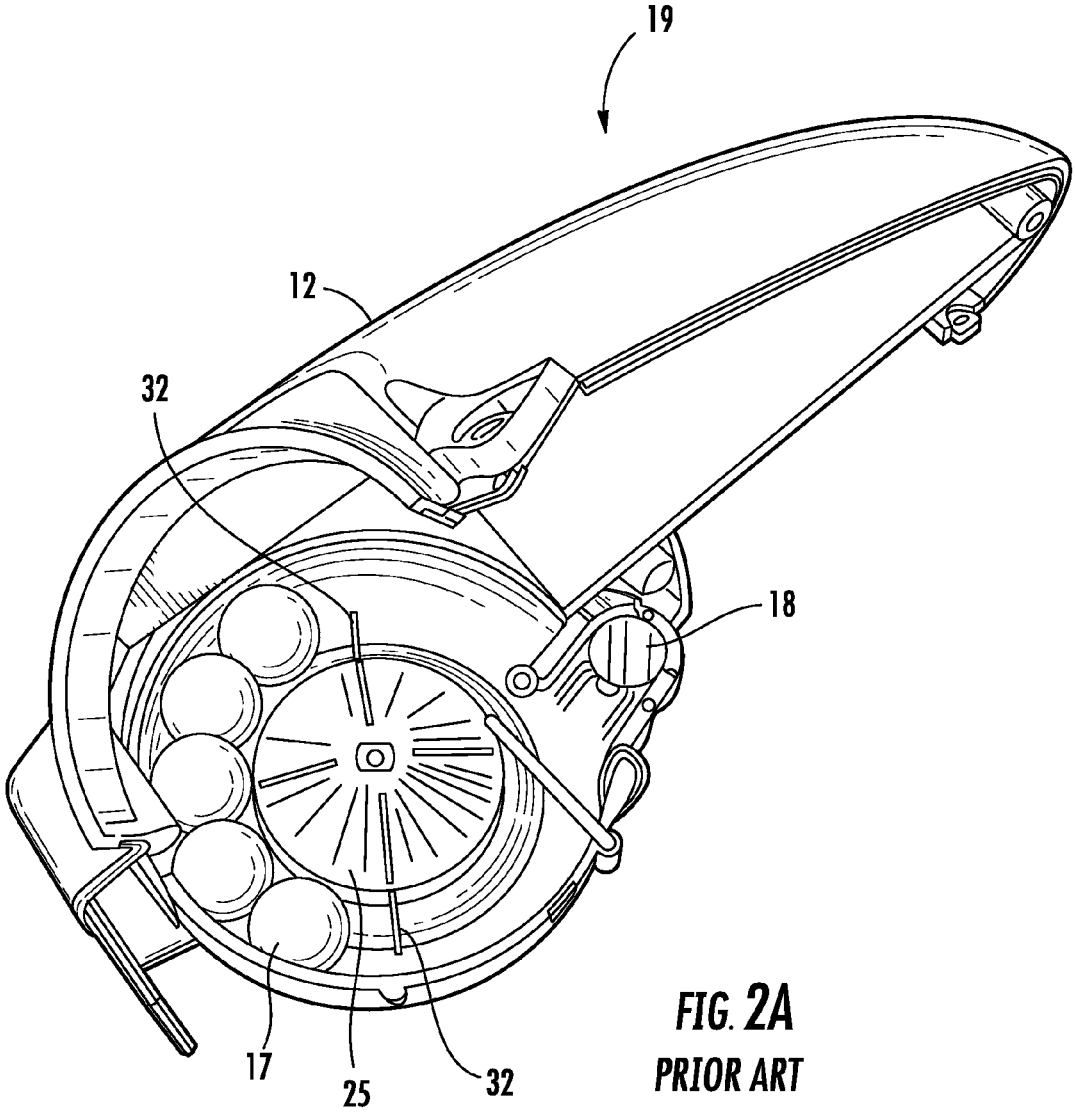
FIG. 2A PRIOR ART
FIG. 2A illustrates a top interior cutaway view of an active feed paintball loader, showing an exit opening, a plurality of paintballs, and an outer shell of the active feed paintball loader, including a drive cone.

In an active feed loader 19, such as shown in FIG. 2A, the feed mechanism is preferably provided as a drive cone 25, a carrier or other conveyor, mounted on a drive shaft 26 coupled to a motor (not pictured). Activation of the motor rotates or otherwise moves the drive shaft 26, and thus moves the feed mechanism 20. Paintballs 17 are driven under force toward and out of the outfeed tube 16, into the breech of a paintball marker 41. In a gravity-feed loader 15, the agitator 22 will operate to mix paintballs 17 adjacent the exit opening 18, to prevent jams for proper feeding. In an active or force feed paintball loader 19, paintballs 17 will be forced by movement of the feed mechanism 20 toward the exit opening 18, and through the outfeed tube 16.

An improved paintball feed mechanism 20 according to the present invention is provided that may be used in place of any known feed mechanism or as part of any paintball delivery device, magazine, loader or hopper arrangement. In one embodiment shown in FIGS. 3-4, an improved paintball feed mechanism 20 includes at least one generally rigid projection 24, or a plurality of projections 24, each connected to a drive shaft 26 by an elastic member 28. The projections 24 may be rigid arms, paddles, prongs, fins, or any similar arrangement capable of agitating, mixing or otherwise moving paintballs. The projection 24 is preferably formed from a generally rigid material such as rigid plastic or metal such as aluminum. In a preferred embodiment, the elastic member 28 is a spring 30. The spring 30 is positioned between the projection 24 and the drive shaft 26, connecting the projection 24 directly to the drive shaft 26. Each independent projection 24 may be separately connected to the drive shaft 26 by a separate elastic member 28. The elastic member 28 may be formed from any acceptable flexible materials, such as elastic plastics or polymers, or rubber materials, without departing from the present invention. If desired, projections 24 may be set in an cover 38, as illustrated in FIG. 3A. In this embodiment, the cover 38 is a high durometer material that includes an elastic element 39 to enclose the spring 30 connecting the projection 24. With this configuration, the paintballs 17 are not subject to irregular contact with the spring 30 windings. The elastic elements 39 may extend directly from the drive shaft 26, without the need for a cover 38.

Preferably, the projection 24 is of a greater length than the elastic member 28, as shown in FIGS. 3-8, allowing more of the rigid projection 24 to contact paintballs and act in agitating the paintballs. In a preferred embodiment, the projection 24 has a length that is at least half the diameter of a paintball 17 being agitated.

The elastic member 28 preferably connects the projection 24 to the drive shaft 26, functioning to support the projection 24 during rotation of the drive shaft 26. The material of the elastic member 28 is selected such that a projection 24 may bend or flex when the projection 24 encounters a stationary or jammed paintball 17 to prevent breakages, as shown in FIGS. 5-8. In addition, the material and attributes of the elastic member 28 are preferably selected so that only a sufficiently immovable force representing a stationary or jammed paintball 17 can cause the elastic member 28 to bend, and thereby move the projection 24. For example, as shown schematically in FIGS. 5-8, viewing the agitator of the present invention from the top, when the drive shaft rotates in the counter-clockwise direction, F represents the force applied to the elastic member 28 and projection 24 by the rotation of the drive shaft 26 by the motor. F' represents the opposing force applied to the elastic member 28 and projection 4 when a projection 24 meets a stationary or jammed paintball 17 that cannot be moved by the feed mechanism 20. The elastic member 28 should be formed from a material that will flex only when F'>F. Preferred materials may have a Modulus of Elasticity (Young's Modulus, "E") of between 0.01 GPa and 10 GPa.

When a paintball stack 50 is moving or when an individual paintball 17 is capable of movement (when a paintball stack 50 is moving in an active feed loader 19 or when there are no jams in a gravity feed loader 15), the elastic member 28 should not bend or flex, so that the rotational force F applied by the motor is translated by the projections 24 to the paintballs 17 being moved. However, upon encountering a stationary or jammed paintball represented by the opposing force F', the elastic member 28 should deform sufficiently to allow a projection 24 to pass the jammed or stationary paintball 17, without breaking or rupturing of the paintball 17, as shown in FIGS. 5-8. Because the projections 24 are only diverted when encountering a stationary or jammed paintball 17, they otherwise function as rigid arms, which can perform better than arms formed completely from flexible materials. If a spring 30 is used as the elastic member 28, the spring 30 must be sufficiently strong so that only a stationary or jammed paintball 17 meeting a projection 24 can flex or bend the spring 30, relative to central axis "A", as indicated by the arrows in FIG. 3.

Figure 3:
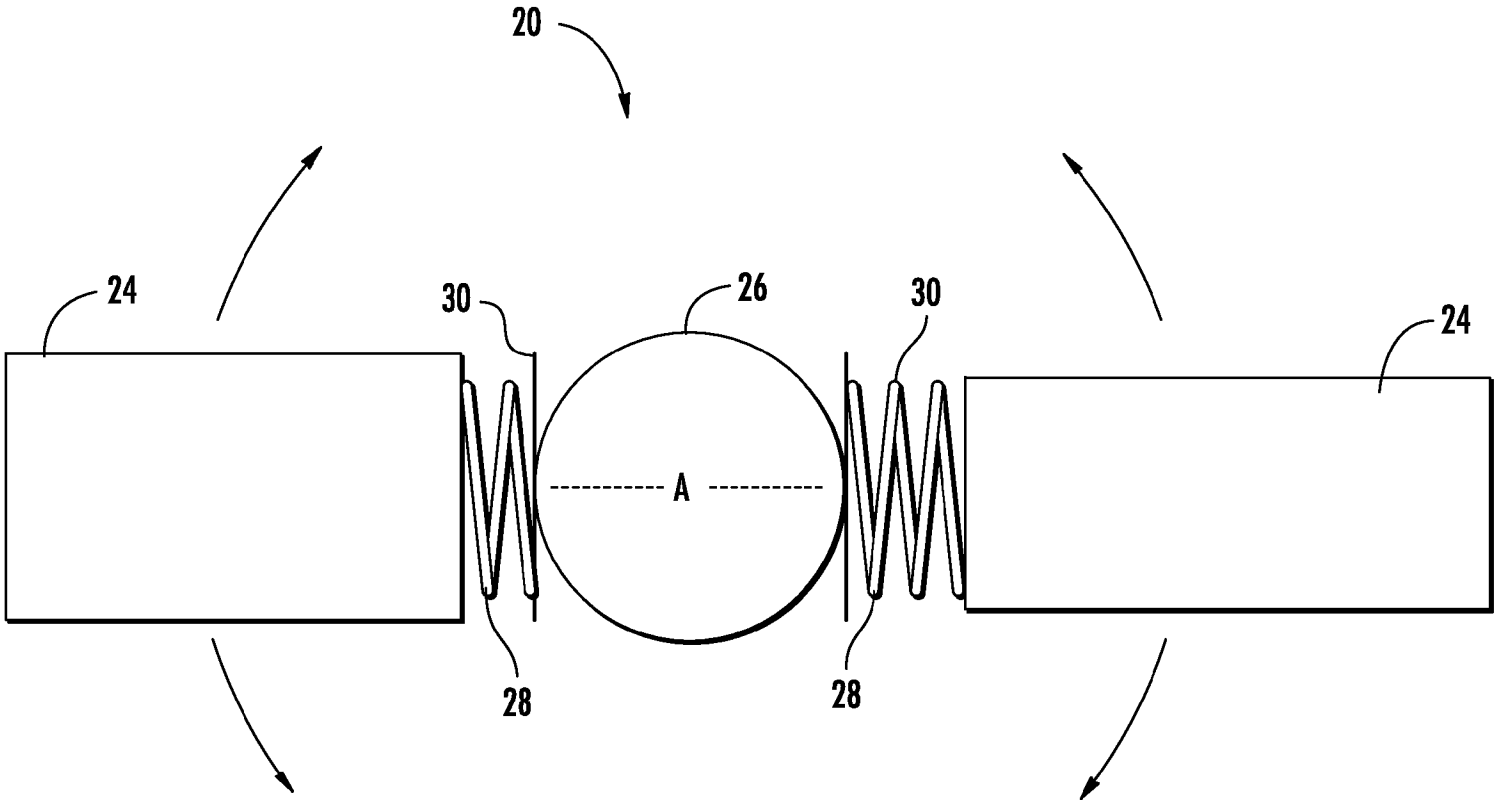
FIG. 3 illustrates a top plan view of an embodiment of a feed mechanism according to the present invention.
Figure 3A:
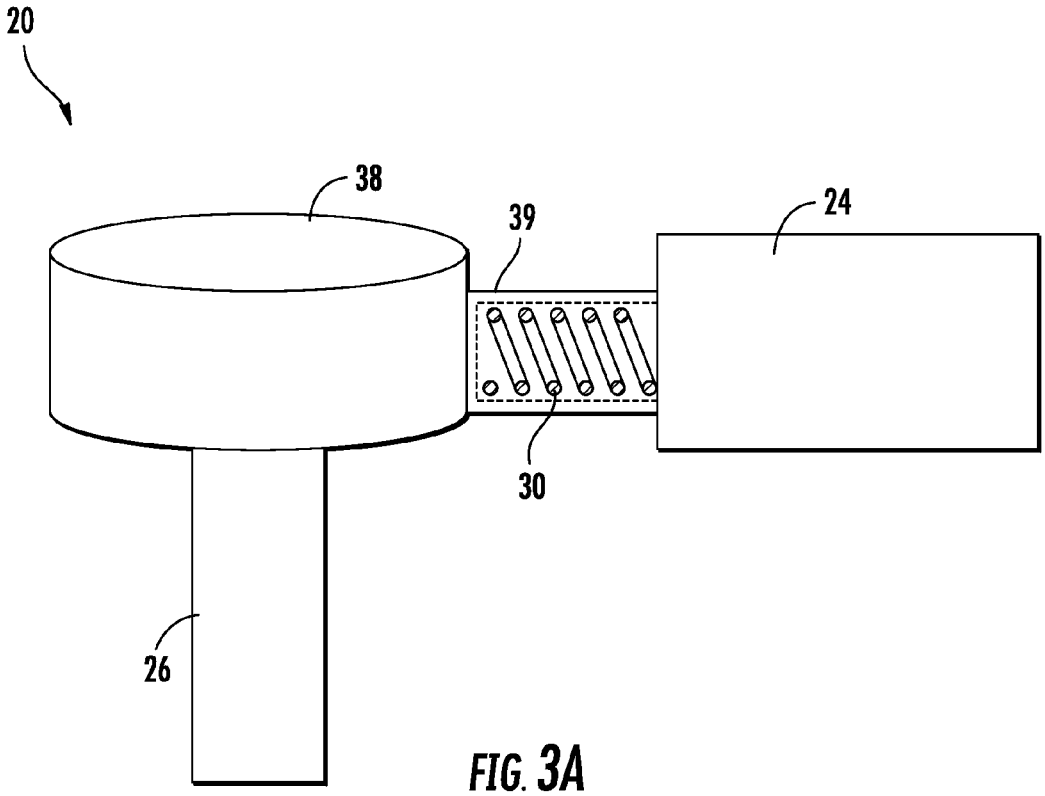
FIG. 3A illustrates a partial perspective view of an embodiment of a feed mechanism according to the present invention.
Figure 4:
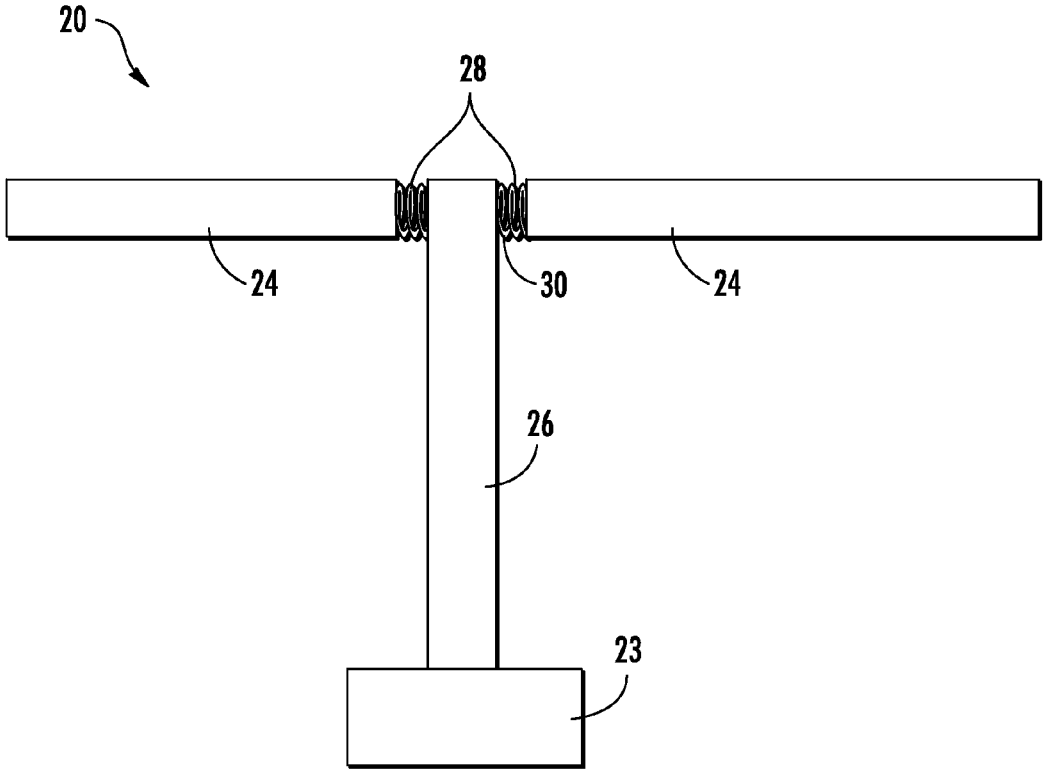
FIG. 4 illustrates a side view of an embodiment of a feed mechanism according to the present invention.
Figure 5:
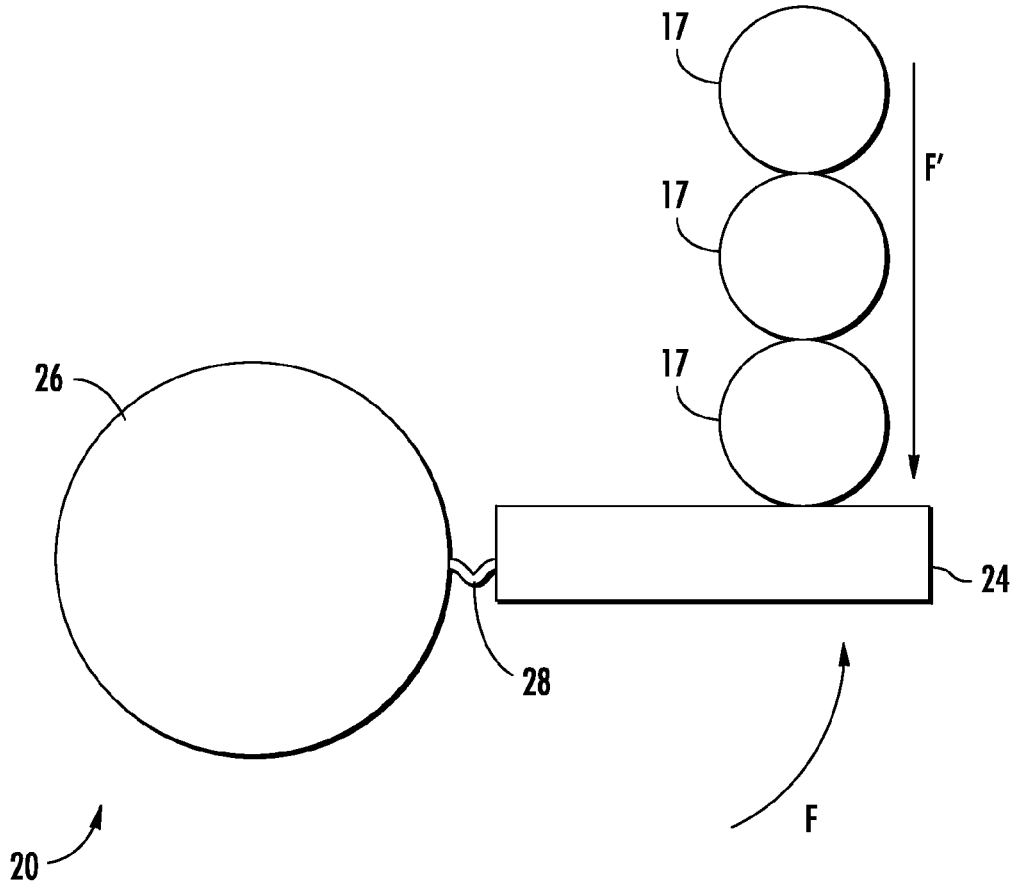
FIG. 5 illustrates a top view of a schematic representation of the operation of an embodiment of a feed mechanism according to the present invention rotating and encountering a stationary or jammed paintball.
Figure 6:
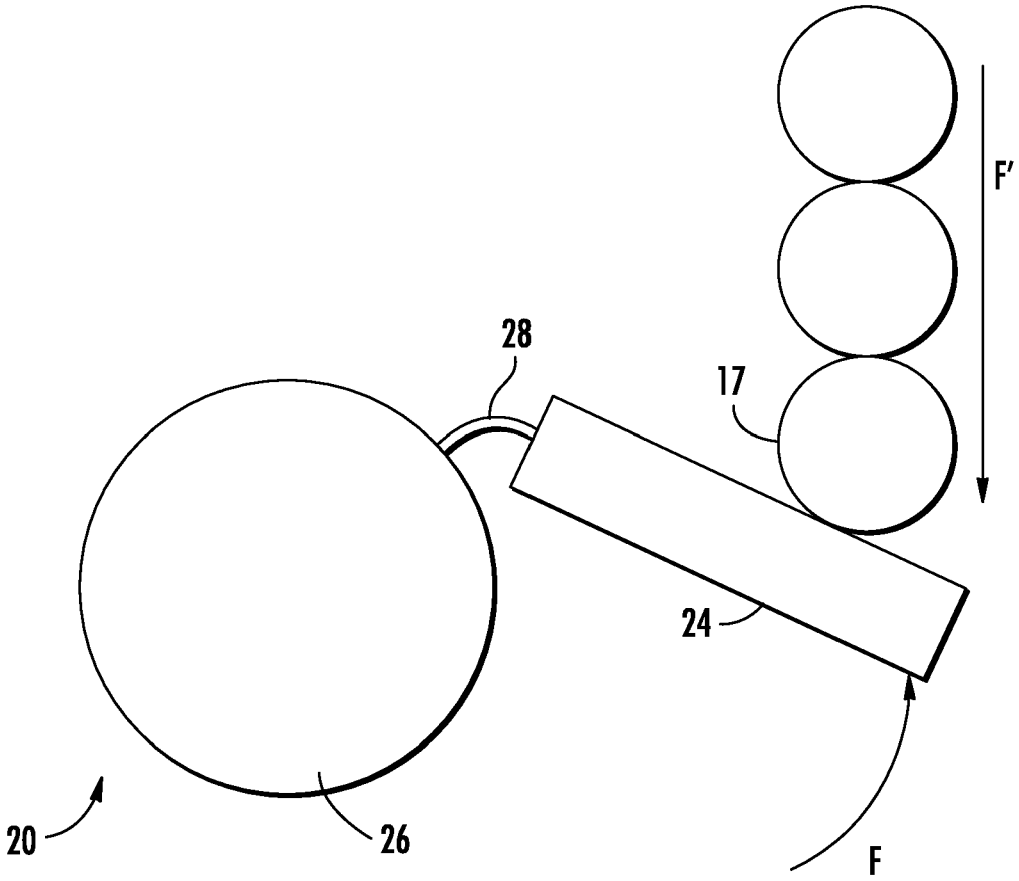
FIG. 6 illustrates the feed mechanism shown in FIG. 5 encountering a stack of stationary paintballs.
Figure 7:
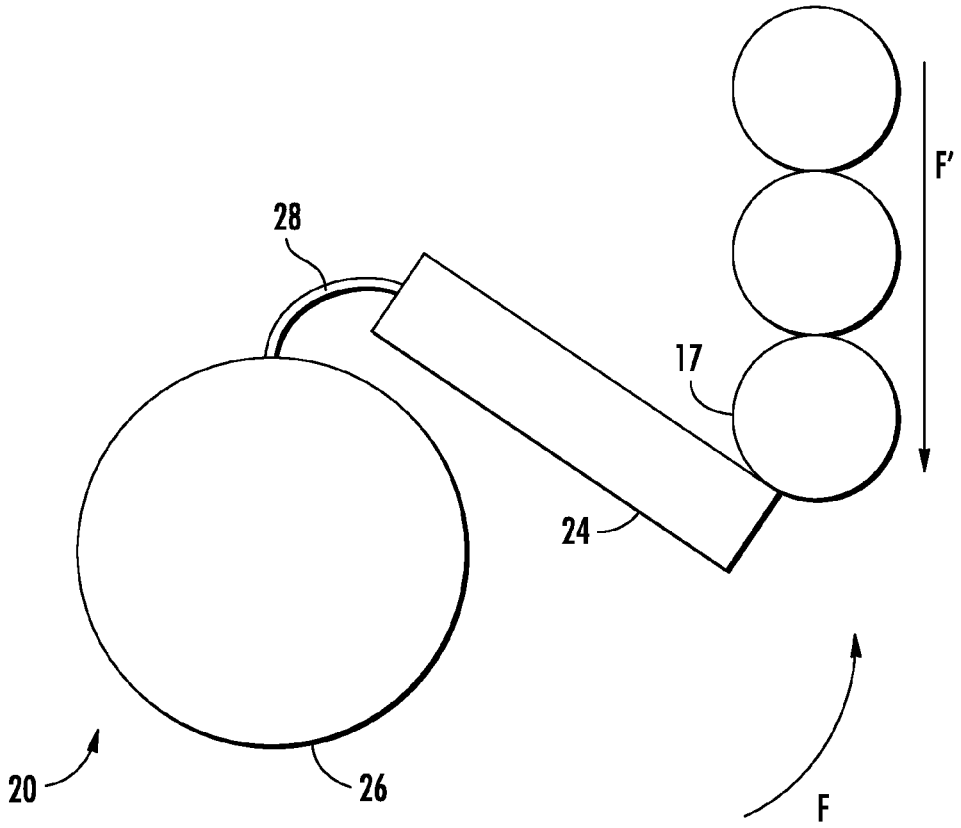
FIG. 7 illustrates the feed mechanism of FIG. 5 with an elastic member that is flexed so as not to breaks paintballs.
Figure 8:
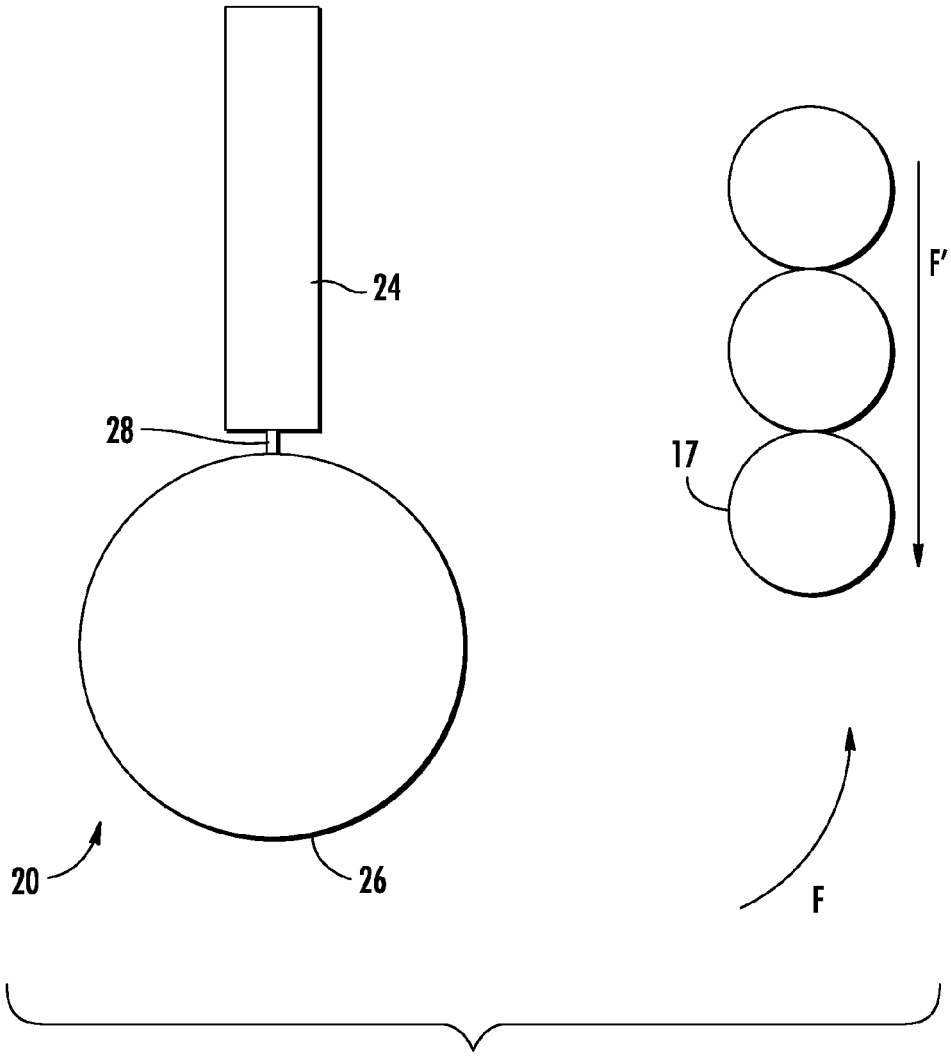
FIG. 8 illustrates the feed mechanism of FIG. 5 having passed by a stack of stationary or jammed paintballs without breaking the paintballs, returning to its non-flexed position.

The embodiments of the improved paintball feed mechanism 20 shown in FIGS. 3-4, are preferably used in connection with a gravity feed loader 15, such as the exemplary one shown in FIG. 2. In those embodiments, the a drive shaft 26 is provided, which is rotated by a motor 23. An elastic member 28 is provided between the drive shaft 26 and outwardly radiating projections 24. In operation, when the motor is activated, the drive shaft 26 turns, moving the projections 24. If paintballs 17 are free to be moved about the housing 12, the projections 24 will agitate or otherwise move the paintballs. However, at some point, paintballs 17 may jam or otherwise cease moving. For example, in a gravity feed loader 15, paintballs 17 may jam at the exit opening 18 of the loader. In that case, the projection 24 will bend via the spring 30 when the projection 24 encounters a non-moving or jammed paintball 32. In that manner, the projections 24 will not rupture the paintball 17.

As shown in FIGS. 9-12A, the improved feed mechanism of the present invention can be formed as a force feed mechanism, where the feed mechanism 20 is provided as a drive cone 25 for use in connection with an active feed loader 19, such as the exemplary active feed loader 19 shown in FIG. 2A. The drive cone 25 has a body 34 including a raised central portion 27 with a top that slopes downward, as shown in the FIGS. 9-11. The drive cone 25 may include a ridge 29 extending along the circumference of the body 34 for at least partially supporting paintballs 17. The drive cone 25 includes at least one fin 32, which is similar to a projection 24. An elastic member 28 is positioned between the fin 32 and the body 34 of the drive cone 25, preferably directly connecting the fin 32 to the drive cone body 34. In a preferred embodiment, the elastic member 28 is a spring 30. If the paintball stack is moving and there are no jammed paintballs 17, as the motor rotates the drive cone 25, the elastic member 28 will not bend, and the fins 32 will force the paintballs 17 from the loader 19. If the paintball stack 50 is stationary or there is a jammed paintball 17, the elastic member 28 will bend and the fins 32 will pass by the stationary or jammed paintballs 17. In addition, if an elastic member 28 is bent when a projection 24 encounters a stationary paintball 17, but the projection 24 does not fully pass the paintball 17, and the motor 23 is shut, the elastic member 28 will store energy for propelling the paintballs 17 from the loader once the motor continues to operate. Thus, tension will be maintained on the paintball stack 50 when the motor 23 is not operating. The kinetic energy stored by the elastic member 28 will assist in moving the paintballs 17 when the motor 23 is actuated.

Figure 16:
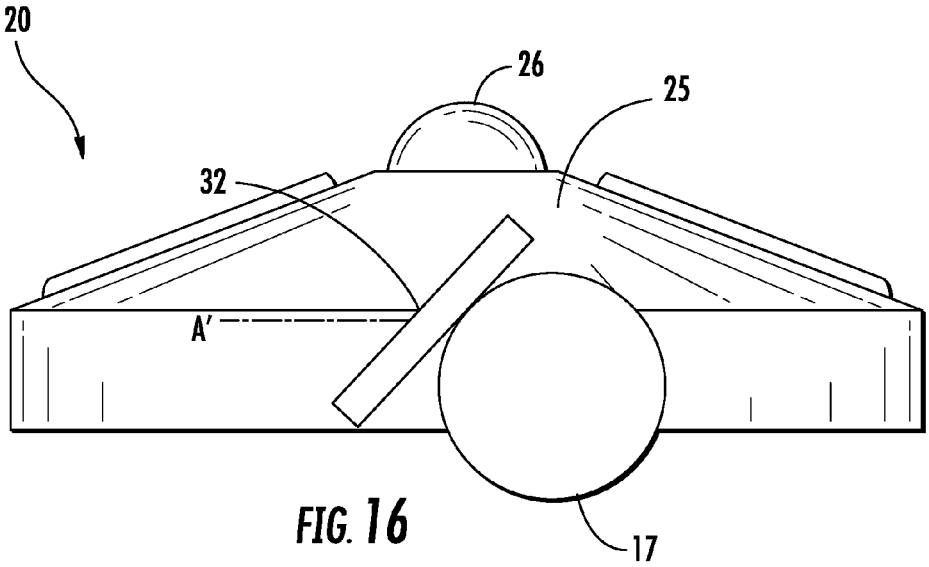
FIG. 16 illustrates another embodiment of a feed mechanism according to the present invention.

In one embodiment of the feed mechanism 20 of the present invention formed as a drive cone 25, the fins 32 or projections 24 may be formed so that they may turn or bend relative to axis A', as shown in FIG. 16. In this manner, in addition to the elastic member 28 bending in the direction opposite of (backwards or away from) a jammed or stationary paintball 17, the fin 32 may also be adapted to "spin" out of the way, further preventing the potential for breakage. In addition, the ridge 29 has been eliminated from this embodiment of the drive cone 25.

Figure 13:
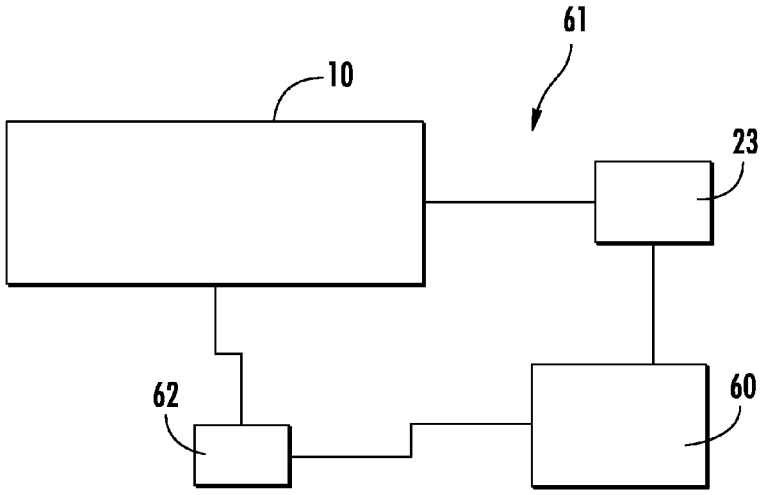
FIG. 13 illustrates a schematic representation of an embodiment of a controller for a paintball loader incorporating the feed mechanism of the present invention including a microprocessor and a sensor.

A paintball loader including a feed mechanism 20 according to the present invention may include a controller 61 including a microprocessor 60 and at least one sensor 62 for controlling the operation of the paintball loader. The microprocessor 60 and sensors 62 are shown in FIG. 2, and are shown schematically in FIG. 13. A sensor 62 may be placed at a preselected location in the loader housing 12, such as, for example, adjacent or in the outfeed tube 16. The sensor 62 for detecting the presence or absence of a paintball 17, or the movement of a paintball stack 50, may be a mechanical, contact, piezoelectric, optical, infrared, or other type of sensor, and may include an emitter and a receiver. The sensor 62 is in communication with the microprocessor 60, which can send a signal to either activate the motor 23 (when paintballs are required by the paintball marker 41 to which the loader 10 is attached), or to deactivate the motor (when a paintball stack 50 is stationary and/or the paintball marker is not firing). The microprocessor 60 can be set to control other operations of the paintball loader 10, such as varying the speed of the motor 23, or reversing the motor 23.

Figure 14:
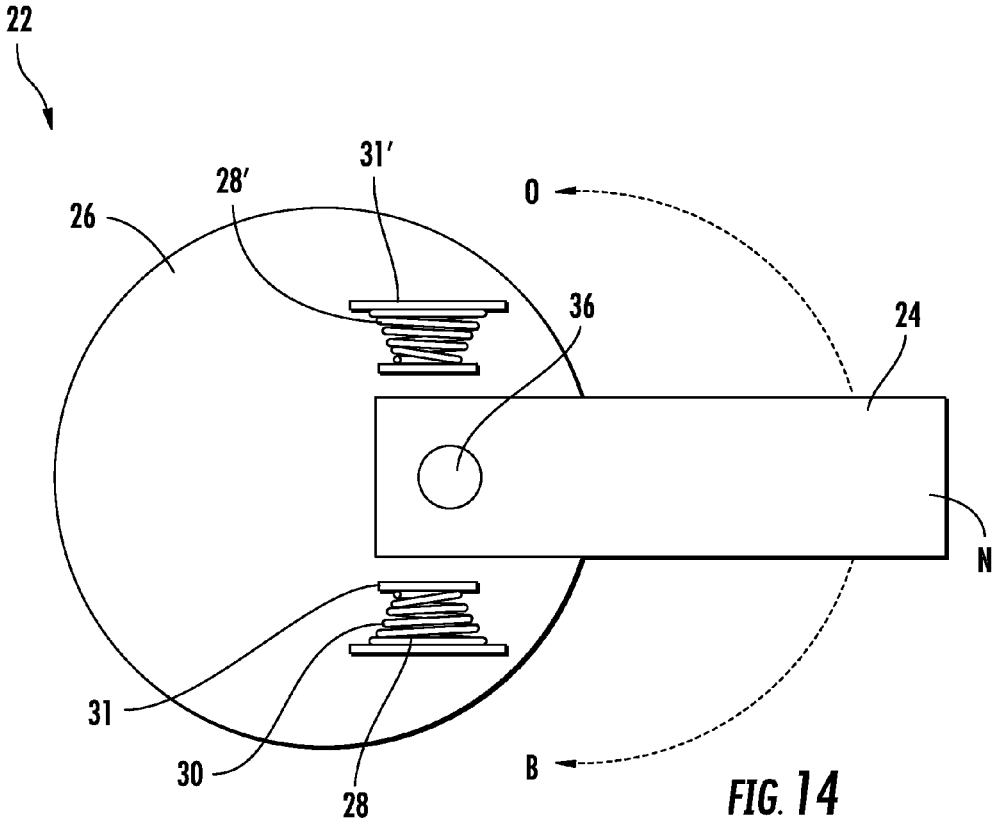
FIG. 14 illustrates another embodiment of a feed mechanism of the present invention.

In yet another embodiment of the present invention, as shown in FIG. 14, an feed mechanism 20 is provided having a drive shaft 26, and a projection 24 moveably attached to the drive shaft 26, such as by a pin 36. The projection 24 is free to move clockwise or counter-clockwise (when viewing the feed mechanism 20 from above) about the pin 36, as shown in FIG. 14, from a first or neutral position N, to a biased or second position B, or to an opposite biased or third position O. At least one elastic member 28 is provided mounted on the drive shaft 26, and positioned to bias the projection 24 opposite the projection's 24 direction of movement.

In one embodiment, the elastic member 28 is preferably a spring 30, as shown in FIG. 14. When the drive shaft 26 is rotated by the motor, the projection 24 may meet a stationary paintball 17. In that case, the projection 24 will rotate about the hinge 26 from position N to position B, until it contacts an end of the spring 30. In this embodiment, spring 30 has a bumper 31, which acts as a portion for contacting the projection 24. The spring 30 will bias the projection 24 in the opposite direction toward the neutral position N. Where a reversible motor is used for rotating the drive shaft 26 either clockwise or counter-clockwise, a second elastic member 28' may be provided located on the opposite side of the first elastic member 28, having a bumper 31'.

Figure 15:
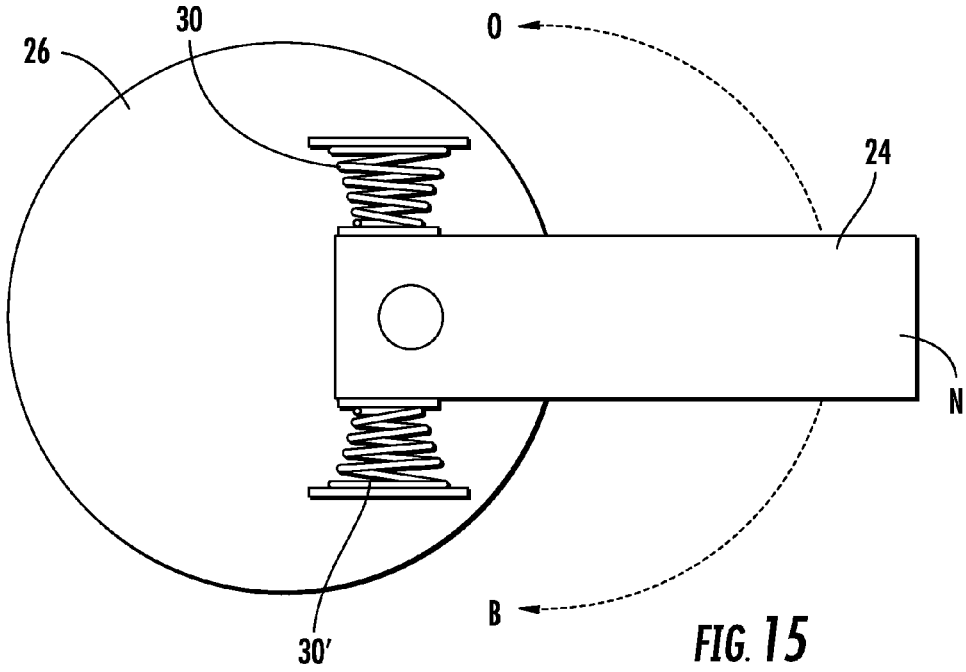
FIG. 15 illustrates another embodiment of a feed mechanism of the present invention.

In another embodiment shown in FIG. 15, rather than a bumper or "push" type elastic member as in FIG. 14, the spring 30 is positioned with one end connected to the drive shaft 26, and the opposite end connected directly to the projection 24. In this arrangement, when projection 24 is moved away from a stationary or jammed paintball, the spring 30 will pull the projection 24 back to the neutral position. Adding a second spring 30' will allow a "push-pull" arrangement, where the projection 24 will be biased by the forces of each spring 30, 30' when the projection 24 moves in either the clockwise or counter-clockwise directions.

The improved paintball agitator of the present invention provides a unique and novel arrangement for preventing paintball jams in either a gravity feed loader such as in FIG. 2, or an active feed paintball loader such as in FIG. 2A, by incorporating projections that are connected to a drive shaft by an elastic member.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to these embodiments which come within the meaning and range of equivalency of said claims are therefore to be embraced therein.

What is claimed is:

1. An improved paintball loader, comprising:

a housing that defines a paintball receiving cavity in communication with an out-feed tube; and a paintball moving device in the housing that urges the paintballs toward the out-feed tube, the paintball moving device including:

a motor;

a drive shaft connected to the motor;

an elastic member connected to the drive shaft; and at least one rigid projection supported by the elastic member, the rigid projection having a length greater than the elastic member.

2. The paintball loader of claim 1, wherein the elastic member is a spring.

3. The paintball loader of claim 1, further comprising a controller for controlling movement of the paintball moving device.

4. A method of agitating paintballs in a paintball loader, comprising:

providing a feed mechanism mounted in the paintball loader, the feed mechanism, comprising:

a drive shaft connected to the motor;

an elastic member connected to the drive shaft; and at least one rigid projection supported by the elastic member, the rigid projection having a length greater than the elastic member;

providing a motor for actuating the drive shaft; and operating the motor to actuate the drive shaft.

5. A mechanism for feeding spherical projectiles out of a holding magazine into the intake port of a gun, which comprises:

a rotating body rotatably mounted in the magazine about a substantially vertical axis;

at least one impelling arm projecting outwardly and substantially radially from said rotating body, the impelling arm comprising a spring member and a rigid projection, the spring member having an internal end portion secured to the rotating body and a peripheral end portion secured to the rigid projection, the impelling arm being positioned, shaped and dimensioned to contact and propel projectiles in the magazine toward the intake port;

a motor having an axle coupled to said rotating body; and a switch for starting and stopping the motor.

6. The mechanism of claim 5, wherein the rotating body is rotatably mounted in a lower region of the magazine.

7. A mechanism for feeding spherical projectiles out of a holding magazine into the intake port of a gun, which comprises:

a rotating body rotatably mounted in the magazine about a substantially vertical axis;

at least one impelling arm projecting outwardly and substantially radially from said rotating body, the impelling arm comprising a spring member and being positioned, shaped and dimensioned to contact and propel projectiles in the magazine toward the intake port;

a motor having an axle coupled to said rotating body, the axle having a slot for receiving an internal end portion of the spring member; and a switch for starting and stopping the motor.

* * * * *